United States Patent [19]

Saga

[11] Patent Number: 4,836,181

[45] Date of Patent: Jun. 6, 1989

[54] SAFETY-DEVICE FOR STOVES

[76] Inventor: Halvor Saga, N-3740 Lunde, Lunde, Norway

[21] Appl. No.: 158,601

[22] Filed: Feb. 22, 1988

[30] Foreign Application Priority Data

Feb. 23, 1987 [NO] Norway ..... 870707
Nov. 2, 1987 [NO] Norway ..... 874556

[51] Int. Cl.[4] ..... F24C 3/12
[52] U.S. Cl. ..... 126/42; 126/211
[58] Field of Search ..... 126/42, 24, 211, 214 R, 126/214 D, 39 B, 201, 202, 37 A

[56] References Cited

U.S. PATENT DOCUMENTS

| | | | |
|---|---|---|---|
| 928,770 | 7/1909 | Knudsen | 126/42 |
| 1,021,198 | 3/1912 | Krug | 126/42 |
| 2,778,356 | 1/1957 | Pugach | 126/42 |
| 4,155,343 | 5/1979 | Hartman | 126/211 |

FOREIGN PATENT DOCUMENTS

| | | | |
|---|---|---|---|
| 183887 | 6/1986 | European Pat. Off. . | |
| 2602835 | 7/1977 | Fed. Rep. of Germany | 126/42 |
| 2658099 | 12/1981 | Fed. Rep. of Germany . | |
| 3026820 | 2/1982 | Fed. Rep. of Germany . | |
| 385402 | 6/1976 | Sweden . | |
| 1568705 | 6/1980 | United Kingdom . | |

*Primary Examiner*—James C. Yeung
*Attorney, Agent, or Firm*—Poms, Smith, Lande & Rose

[57] ABSTRACT

Children safety device for cookers or stoves where such a device must be used when using the stove. The children safety device comprises a front plate which may be raised in tracks and cooperating side plates which together comprise an at least partially peripheral obstacle, and optionally an additional down-folding panel which may cover the switch panel and/or the stove door in a down-folded position.

8 Claims, 2 Drawing Sheets

SAFETY-DEVICE FOR STOVES

The present invention concerns a safety-panel for children on cookers and stoves, where the panel is movable and prevents children from hurting themselves either by use or when the stove is turned off.

Many accidents happen in the house, and many such accidents involve children using stoves. Since children are curious and not always conscious of the dangers of household apparatuses, it is important to provide safety devices which prevent the children from being hurt. In this connection children safety devices on cookers/-stoves are very important, both because the child may become seriously burnt by hot material such as pots or hot fat inside pots on top of the stove, and because the stove may be ruined if the child turns on the switches in the control panel on the stove. It is an object of this invention to prevent children from turning on stoves, preventing possible fires from occurring.

It is important that two modes of operation are achieved in children safety devices, namely that the child does not come to harm, and that the stove is not damaged by, for example, overheating. Such a children safety device ought to be safe for a child both from the front and the sides of the cooker/stove.

There are previously known different devices which attempt to produce children safety devices for stoves, where one or the other of the above mentioned modes of action are attempted to be achieved.

There is thus known from German Pat. No. DE 21658.099 to Friedlaender, dated Dec. 10, 1981, a folded stove switch panel where the switches are not accessible in the folded position. Such a device has, however, for its purpose mainly the protection of the clockwork inside the switch panel and produces no safety mode for the plates or the pots which may be present on top of the stove.

Also European Pat. No. 0.183.887 to Pavarin, dated June 11, 1986, discloses a switch panel on a stove, where the switch panel is protected by fastening a plate in front of the switches. Here there is, however, neither produced protection for the heating plates or the pots which may be present on top of the stove.

In Swedish Pat. Publ. No. 385.402 to Sanders, et al., dated June 28, 1976, there is disclosed a children safety device where there is achieved security for both the switch panel and the heating plates of the stove. Such a children safety device has however the disadvantage that the user may forget to mount/fold down the safety device during use of the stove, and thus the children safety device completely loses its function.

In addition, when such a safety device is not in use, it is not certain that the switch panel is not accessible.

It is thus a purpose of the present invention to produce a children safety device for cookers/stoves where such a safety device during use of the stove protects against the accessibility to the heating plates and the switch panel, and when the stove is not in use protects against the accessibility to the switch panel at the same time that such a children safety device must be used when the stove is to be used.

To achieve these purposes there is produced a children safety device for stoves comprising the features which appear from the scope of the following claims.

According to the invention the front part of the children safety device may be directed in its up-and-down movement by directing devices such as directing tracks which may be mounted on the sides of the stove. Such tracks may optionally provide that the front panel of the safety device may not be demounted and that the safety device must be used when the stove is to be used.

The front part of the children safety device may in addition comprise steering tracks for its side walls so that such side walls are erected simultaneously as the front plate is raised. For this purpose the side walls of the children safety device according to the invention may be hinged in the heating plate part/top part of the stove, preferably horizontally.

The children safety device according to the invention may also, as a possible and optional feature, comprise an additional front panel which may slide on the outside of a first front panel. Such an additional downfolding front panel has the purpose of protecting against accessibility to the cooker's/stove's switch panel and/or stove handle when the stove and the children safety device is in use in the upfolded position.

The children safety device according to the invention may be made of any convenient material such as plastic or metal. For the user of the cooker/stove to have control over the indicator lamps which show whether heating plates/stove are/is in use, the children safety device according to the invention is preferably made of a fine mesh or transparent heat resistant plastic or corresponding material.

One embodiment of the present invention will below be described below in connection with the attached drawings, wherein:

FIG. 1 shows the device according to the invention in a first embodiment in upfolded position, where the switch panel may be served at the same time as possible pots and frying pans are secured from accessibility for children. In this embodiment there is not mounted an extra down-folding panel in front of or behind the front panel 1 of the children safety device (see FIG. 3). The side wings 2 are hinged about the axis A1—A3 so that these may be folded down in 90° in correspondence with the top plate 3 of the stove. The front panel 1 of the device must accordingly slide down in tracks A6 in securing plate 4 simultaneously as the bolt A4 slides along track A5 when the side wings 2 are folded down.

In the figures A2 represents a steering bolt for the front plate sliding in track A6. A7 is a track for fastening screws for different stove types.

Figure 5:
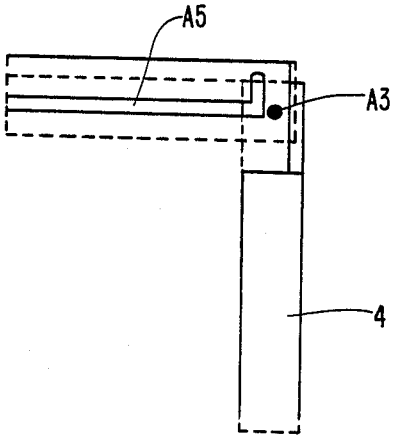

FIG. 5 shows that the device may be locked in an open position on account of that the sliding track A5 has an angle of 90° as shown in the drawing. Bolt A4 locks accordingly the side wings in a vertical position when the front plate is pressed a little down from completely upfolded position. The block (lock) is accordingly made free by lifting the front plate a bit up so that bolt A4 gets out from the angle track and may be moved feely along the sliding track A5. The side wings may now be folded down with a slight pressure. The front plate slides thereby also down along the sliding track A6 and blocks the switch panel.

Figure 1:
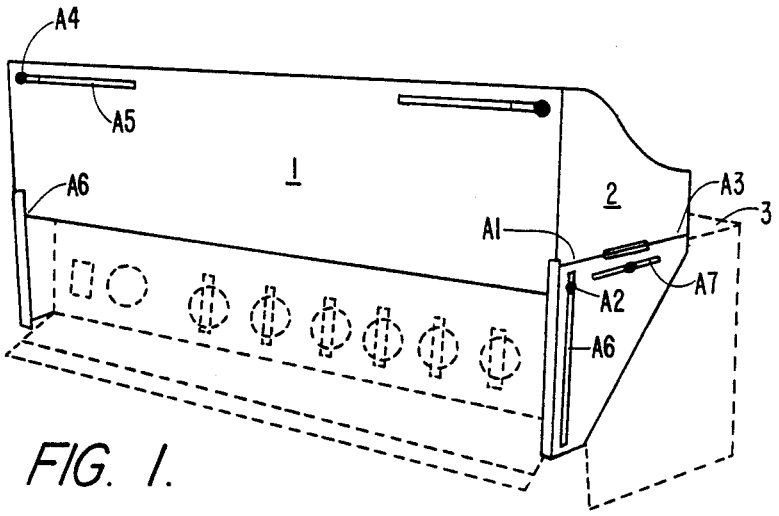
Figure 2:
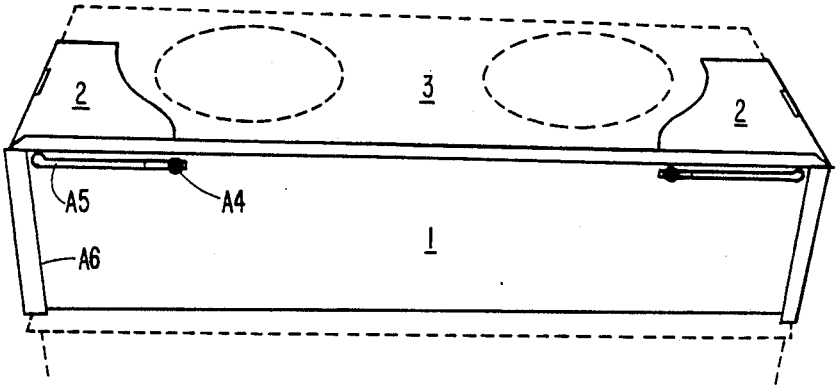
FIG. 2 shows an embodiment of the device according to the invention in a down-folded position. In this position the switch panel of the stove is protected behind the front plate 1, and can not be served unless the children safety device is folded up.
Figure 3:
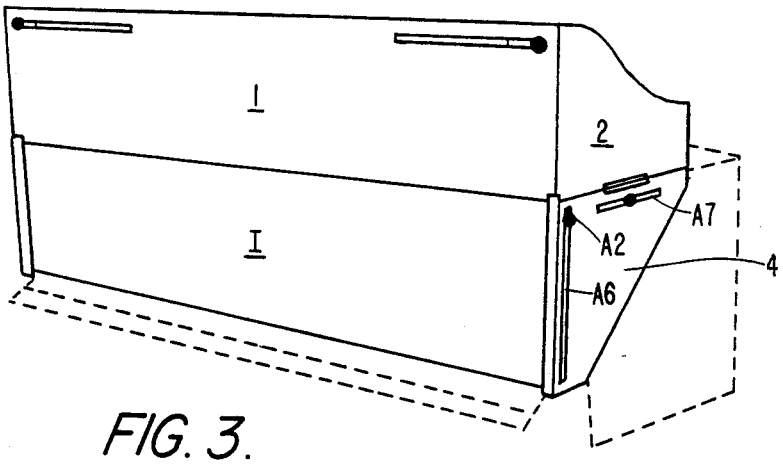
FIG. 3 shows a second embodiment of the invention which comprises an additional front panel I which may slide in the same tracks as or different tracks then the leading tracks for front panel 1. Such an additional panel has the purpose to slide down and block for unintended use of both the switch panel of the stove and the door of the stove.
Figure 4:
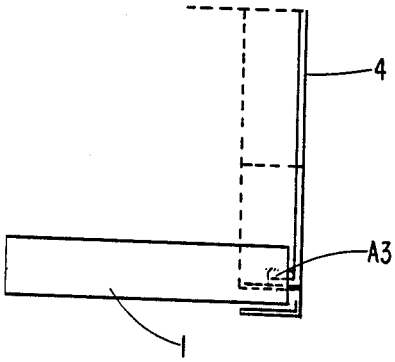

FIG. 4 shows how the front plate is secured to the fastening plate.

I claim:

1. A children safety device for cookers/stoves having a switch panel and heating plates comprising at least one plane, vertical, first front panel (1), side walls (2) pivotably secured to said stove and slidably engaging said front panel, said front panel (1) slidably engaging securing plates (4) mounted on said stove so that said front panel (1) is capable of being selectively moved into (a) a down-folded position extending downward and covering at least said switch panel of said stove, and (b) into an upfolded position comprising at least a partly peripheral obstacle to prevent accessibility to said heating plates of said stove, said side walls (2) cooperating with said vertical front panel (1) by slidably engaging said front panel (1) to selectively provide said down-folded and upfolded positions.

2. A children safety device according to claim 1, wherein said front panel comprises at least one vertical leading track.

3. A children safety device according to claim 2, wherein said front panel (1) has leading tracks for said side walls.

4. A children safety device according to claim 3, wherein said side walls have horizontal hinges mounted on the stove top.

5. A children safety device according to claim 4, further comprising a second front panel (I) which may be folded down below the lower edge of the first panel (1).

6. A children safety device according to claim 5, wherein said second panel (I) has sliding means for folding down said second panel (I).

7. A children safety device according to claim 6, wherein said second panel (I) may be folded down as for a to the oven door of said stove.

8. A children safety device according to claim 7, wherein said first (1) and second (I) panel is made of netting or heat resistant transparent plastic.

* * * * *